US008956077B2

(12) United States Patent
Abeles

(10) Patent No.: US 8,956,077 B2
(45) Date of Patent: Feb. 17, 2015

(54) PORTABLE WATER-INFLATABLE BARRIER

(71) Applicant: Gary E Abeles, Verona, NJ (US)

(72) Inventor: Gary E Abeles, Verona, NJ (US)

( * ) Notice: Subject to any disclaimer, the term of this patent is extended or adjusted under 35 U.S.C. 154(b) by 143 days.

(21) Appl. No.: 13/663,756

(22) Filed: Oct. 30, 2012

(65) Prior Publication Data

US 2013/0108372 A1 May 2, 2013

Related U.S. Application Data

(60) Provisional application No. 61/553,403, filed on Oct. 31, 2011.

(51) Int. Cl.
*E02B 7/20* (2006.01)
*E02B 3/10* (2006.01)

(52) U.S. Cl.
CPC ..... *E02B 3/108* (2013.01)
USPC ..... 405/111; 405/114; 405/115

(58) Field of Classification Search
CPC ..... E02B 3/108; E02B 7/005
USPC ..... 405/15, 16, 17, 18, 107, 111, 114, 115, 405/116
See application file for complete search history.

(56) References Cited

U.S. PATENT DOCUMENTS

| | | | | | |
|---|---|---|---|---|---|
| 3,213,628 | A * | 10/1965 | Serota | 405/111 |
| 4,692,060 | A * | 9/1987 | Jackson, III | 405/115 |
| 5,059,065 | A * | 10/1991 | Doolaege | 405/115 |
| 5,125,767 | A * | 6/1992 | Dooleage | 405/115 |
| 5,176,468 | A * | 1/1993 | Poole | 405/23 |
| 5,857,806 | A * | 1/1999 | Melin | 405/115 |
| 5,865,564 | A * | 2/1999 | Miller et al. | 405/115 |
| 6,022,172 | A * | 2/2000 | Siyaj | 405/110 |
| 6,481,928 | B1 * | 11/2002 | Doolaege | 405/115 |
| 6,551,025 | B2 * | 4/2003 | Dery | 405/115 |
| 6,641,329 | B1 * | 11/2003 | Clement | 405/115 |
| 2004/0047688 | A1 * | 3/2004 | Clement | 405/115 |
| 2005/0260038 | A1 * | 11/2005 | Sousa Costa | 405/115 |
| 2006/0099033 | A1 * | 5/2006 | Boraggina | 405/107 |
| 2007/0140598 | A1 * | 6/2007 | McGillick et al. | 383/22 |
| 2007/0237586 | A1 * | 10/2007 | Prestininzi | 405/115 |
| 2009/0274519 | A1 * | 11/2009 | Shaw | 405/107 |
| 2010/0284747 | A1 * | 11/2010 | Peterson et al. | 405/114 |
| 2014/0010601 | A1 * | 1/2014 | Bradley et al. | 405/302.7 |

FOREIGN PATENT DOCUMENTS

| | | | | |
|---|---|---|---|---|
| DE | 10119011 | C1 * | 2/2003 | E04H 9/14 |
| FR | 2860251 | A1 * | 4/2005 | E02D 17/18 |

* cited by examiner

*Primary Examiner* — Frederick L Lagman
(74) *Attorney, Agent, or Firm* — Maine Cernota & Rardin

(57) ABSTRACT

A portable, water-filled barrier emulates a sandbag dike or wall without requiring sand or intensive labor to install. The barrier is made of a light, flexible material that can include nanofiber. Some embodiments are formed from a plurality of interlocked water-filled cells, with a forward-facing water barrier sheet. Other embodiments are unitary shells that are internally divided into cells, with internal openings that permit water to flow between cells. Automatic valves can seal the filled cells, so that a punctured cell will not cause cells below and behind to deflate. A row or rows of cells can project below the base into a stabilizing trench. Cells can include internal or external rods or plates that support the horizontal structure. Embodiments can be initially filled with air, positioned, and then filled with water while the air escapes through a pressure valve. Barrier end structures can enable interlocking of adjacent units.

33 Claims, 9 Drawing Sheets

PORTABLE WATER-INFLATABLE BARRIER

RELATED APPLICATIONS

This application claims the benefit of U.S. Provisional Application No. 61/553,403, filed Oct. 31, 2011, which is herein incorporated by reference in its entirety for all purposes.

FIELD OF THE INVENTION

The invention relates to temporary barriers, such as dikes used for flood control, and more particularly, to water-filled portable barriers.

BACKGROUND OF THE INVENTION

Circumstances sometimes arise where a temporary dike, wall, or other barrier is needed to prevent a flood, landslide, or other threat from spreading and threatening lives and property. Often, such a temporary barrier is constructed from sandbags, whereby empty bags and a quantity of dirt or sand is brought to the site, and a crew of workers fills the bags with the dirt or sand and stacks the bags to form the barrier. With reference to FIG. 1, the bags are often stacked so as to form a barrier with a "pyramid" cross-section 100 that is widest at the base, and narrower at the top.

In some cases, the barrier 100 is constructed on flat ground, and the weight of the sand in the barrier 100 is sufficient to hold the barrier 100 in place during the flood or other threat. With reference to FIG. 2, in other cases a shallow trench 200 is prepared first, the trench having a depth that is approximately equal to the thickness of one sandbag. One or two rows of sandbags 202 are laid in the trench 200, with the remainder of the barrier 100 being constructed on top of the initial one or two rows 202. In this way, friction between the sandbags in the trench and the remainder of the sandbags further helps to hold the barrier in place.

While a sandbag barrier is generally effective and the materials are relatively inexpensive, there can be significant costs and construction time associated with a sandbag dike, due to the requirement to bring the sand or dirt to the construction site, which may weigh many tons, and due to the need to employ significant labor to fill and stack the bags.

In addition, after the flood or other threat has subsided, disposal of the sandbags can be time consuming and costly, especially if the sand and bags have become wet and contaminated by flood water and require special disposal procedures to avoid risks to health and to the environment.

What is needed, therefore, is a portable dike, wall, or other barrier that functions in a manner similar to a sandbag dike or wall, but does not require delivery of large quantities of heavy materials to the construction site, does not require large amounts of labor to assemble, and is simple and inexpensive to remove when it is no longer needed.

SUMMARY OF THE INVENTION

A portable, water-inflatable barrier has an internal structure similar to a sandbag dike or wall, and functions in a similar manner, but does not require delivery of large quantities of heavy materials to the construction site, does not require large amounts of labor to assemble, and is simple and inexpensive to remove when no longer needed. The barrier is made of a light, flexible material such as a heavy plastic or nanofiber, and can be transported to the construction site in a deflated state, after which it is positioned and filled with locally available water.

In one general aspect of the present invention, the barrier is a single unit that includes shaping and internal partitions which create an overall structure similar to a sandbag wall. The interior of the barrier is divided into a plurality of approximately rectangular cells. Passages between the tops and bottoms of the cells allow the entire barrier to be filled from a single water inlet. In some embodiments, the cells include passive automatic valves that seal the passages after the cells are filled with water, so that deflation of one cell due to a puncture or some other cause will not cause the cells beneath it to deflate. In various embodiments, the outer shell of the barrier is made of a thicker material, such as thick plastic, a synthetic rubber, or a thick layer of nanofiber, so as to better resist puncture by an external threat. In similar embodiments, the outer shell is double-walled, so that puncture of the outer wall does not affect the internal cells, so long as the inner wall remains intact. In certain embodiments the walls are coated with a protective material such as tyvec or liquid rubber that will seal punctures if they occur.

The unitary nature of the barrier in these embodiments eliminates any concern about interlocking and potential separation of individual units. The internal structure of the barrier enables it to maintain its shape when the barrier is subjected to externally applied horizontal forces, such as pressure from flood waters. In some embodiments, the shape of the structure is made even more rigid by the inclusion within the cells of stiff, lightweight rods or plates made of plastic, bamboo, or a similar material.

In further embodiments, additional rows of cells extend below the base of the inflatable barrier so that they can be placed in a trench prepared at the construction site, thereby further resisting dislodgement of the barrier by flood waters or other forces.

In various embodiments, the barrier can be initially inflated with air, so that the barrier can be easily positioned while it is in its filled configuration. The barrier can then be filled with water, while the displaced air is released through a pressure valve at the top of the barrier.

In circumstances where a long dyke or other barrier is required, a plurality of barriers of the present invention can be placed side-by-side. In some embodiments, the barriers have interlocking ends that provide structural cooperation and a water-tight seal between adjacent barriers. In some of these embodiments, pre-inflation of the barriers with air allows them to be easily placed in their interlocking configuration before the air within the barriers is replaced by water.

In a second general aspect of the present invention, the barrier is assembled from individual, water-inflatable modules that interconnect with each other, by ties, hook-and-loop, or by any other attachment mechanism known in the art. In some of these embodiments, the individual modules are triangular or wedge-shaped in cross section, thereby allowing the modules to be assembled so as to create an overall shape that is optimal for a specific circumstance.

Embodiments of the present invention include an anchoring sheet that surrounds part or all of the barrier, or is otherwise attached to the barrier, and extends flat against the ground in front of the barrier, so that the weight of the water in front of the barrier presses the anchoring sheet against the ground and creates a high frictional resistance to movement, thereby anchoring the barrier in place. In some embodiments, the anchoring sheet covers a water-facing surface of the barrier, and is sufficiently flexible to allow it to conform closely with the underlying shape of the water-facing surface. And in some of these embodiments, the anchoring sheet is made from a material that naturally clings to the water-facing surface of the barrier due to static electrical attraction.

Other embodiments include a flexible underlying sheet that further resists puncture from beneath, and which seals to the ground so as to resist penetration of water beneath the barrier. In some of these embodiments, the underlying sheet includes a cushioning layer. In other of these embodiments, the underlying sheet is filled with dry sand, foam or some other compliant material that will not get wet from the flood water.

In various embodiments, a base width of the barrier is at least six times as large as a height of the barrier.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
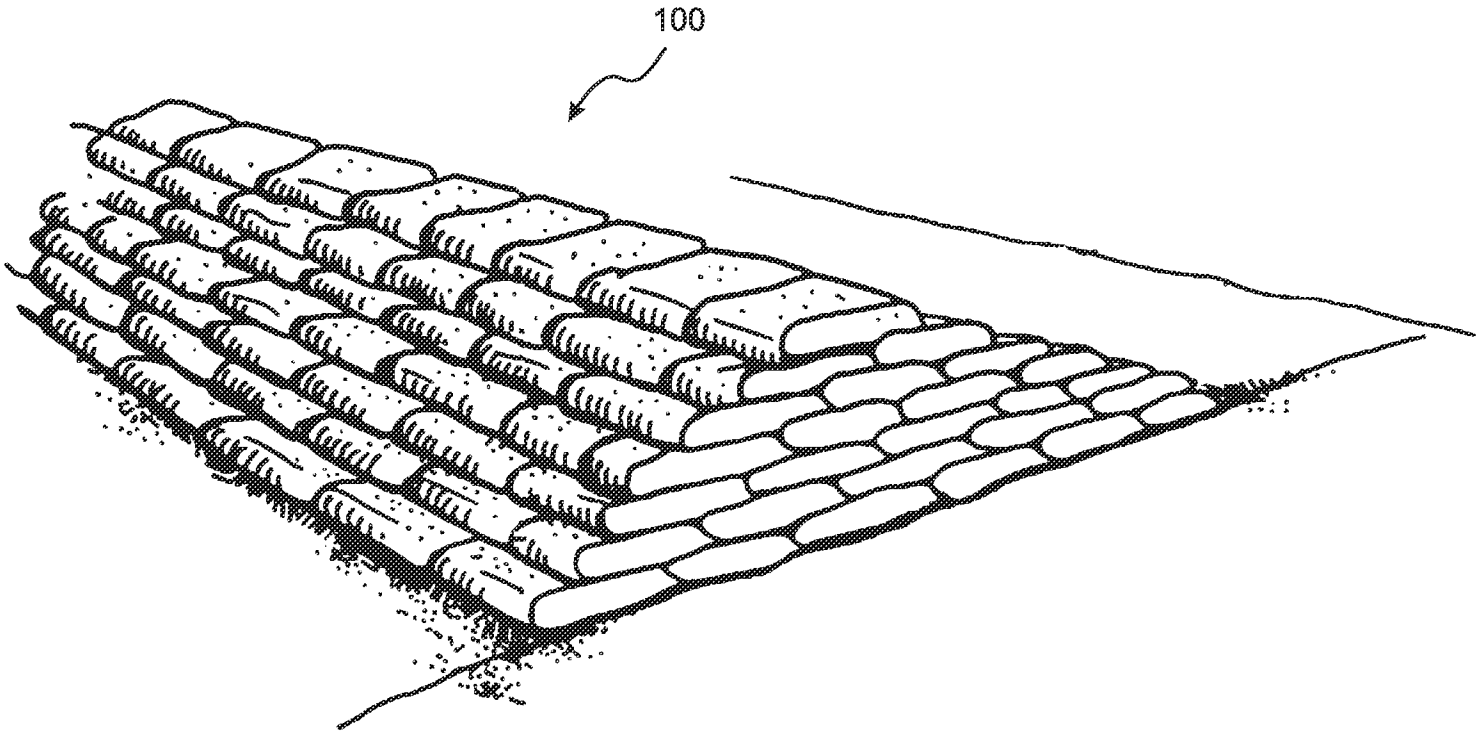
Figure 1 Prior Art
FIG. 1 is perspective view of a sandbag barrier of the prior art having a flat base.
Figure 2:
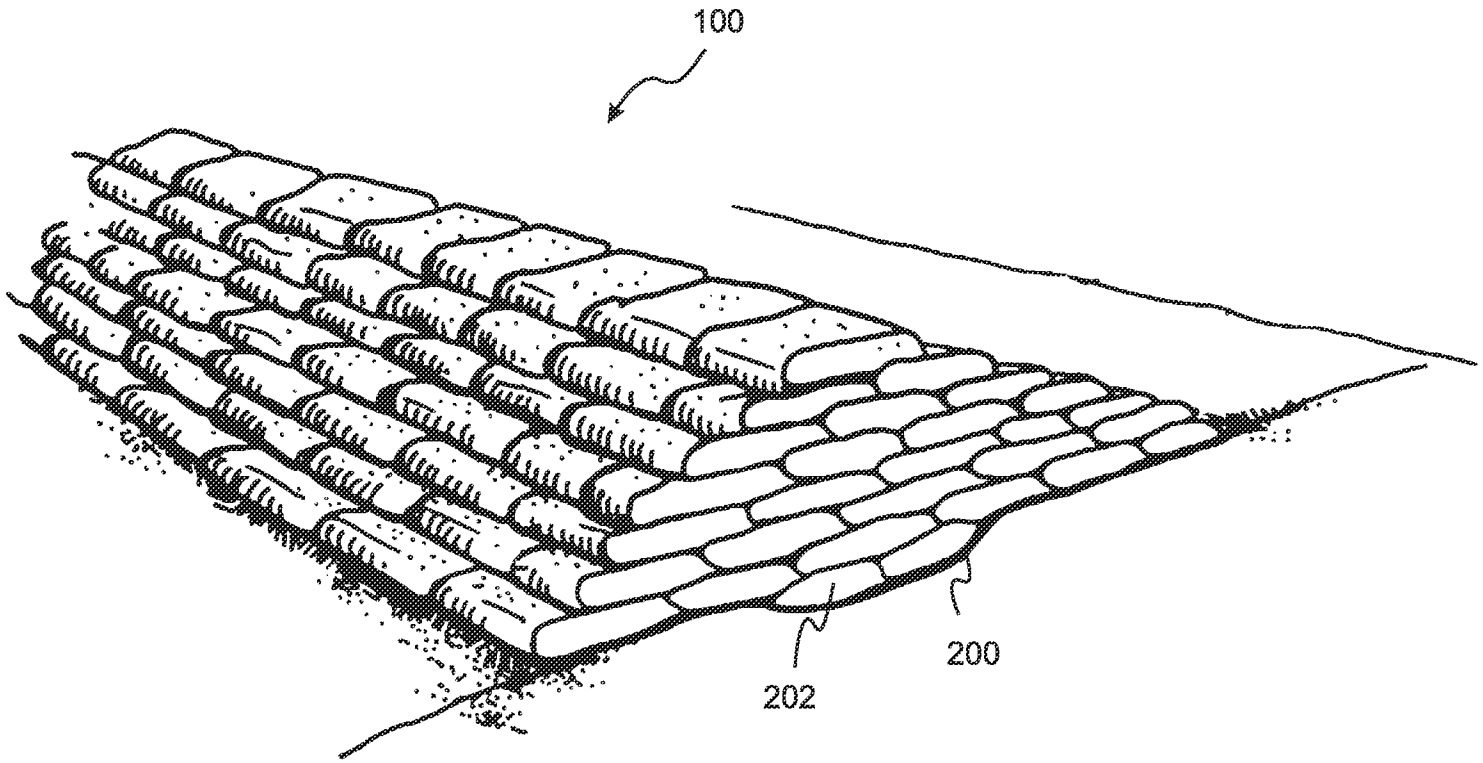
Figure 2 Prior Art
FIG. 2 is perspective view of a sandbag barrier of the prior art having two rows of sandbags at its base that are placed in a trench prepared at the construction site.
Figure 3:
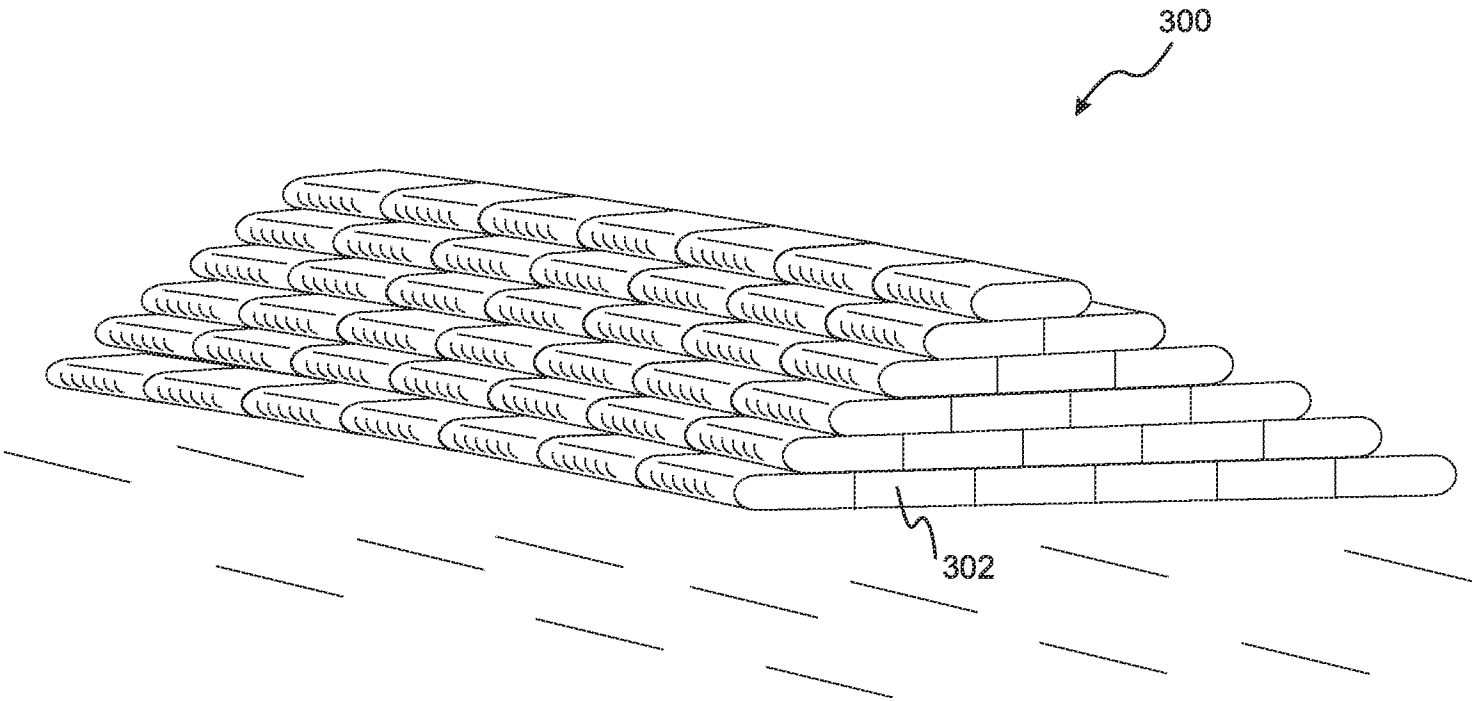
FIG. 3 is a perspective view of an embodiment of the present invention.

With reference to FIG. 3, the present invention is a portable, water-inflatable barrier 300 that has a structure similar to a sandbag dike or wall 100 and functions in a similar manner, but does not require delivery of large quantities of heavy materials to the construction site, does not require large amounts of labor to assemble, and is simple and inexpensive to remove when no longer needed. The barrier 300 is made of a light, flexible material, such as a heavy plastic for nanofiber, and can be transported to the construction site in a deflated state, after which it is positioned and filled with locally available water. In embodiments, the barrier material is coated with a material such as tyvec or liquid rubber that will tend to seal any puncture of the material that may occur.

Figure 4:
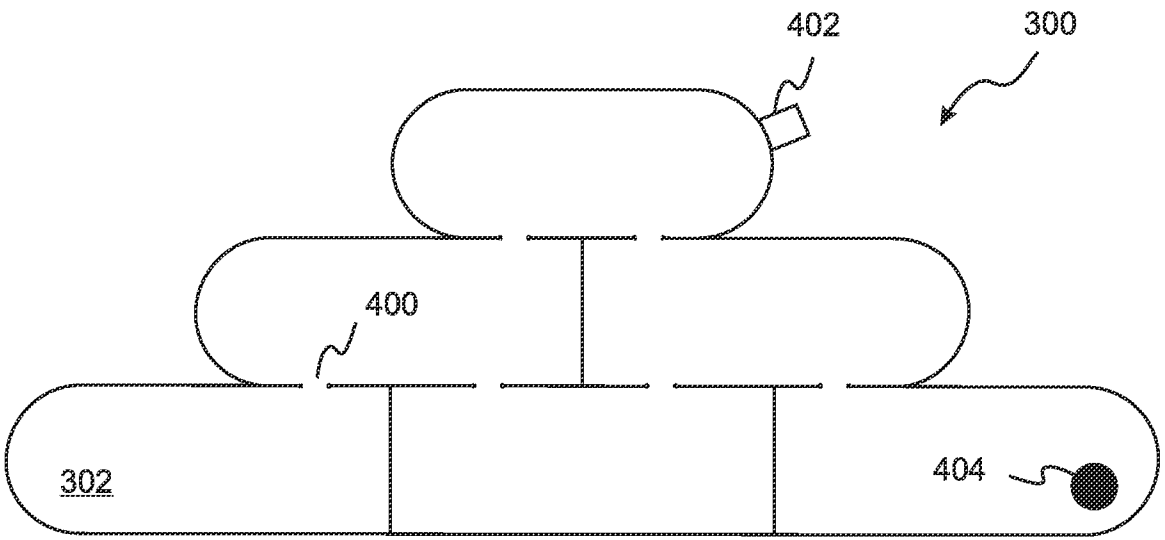
FIG. 4 is a cross sectional view of an embodiment having simple passages between tops and bottoms of cells.

FIG. 3 illustrates an embodiment of a first general aspect of the present invention in which the barrier is a single unit 300 that includes shaping and internal partitions which create an overall structure similar to a sandbag wall. The interior of the barrier is divided into a plurality of approximately rectangular cells 302. With reference to FIG. 4, passages 400 between the tops and bottoms of the cells 302 allow the entire barrier 300 to be filled from a single water inlet 402. A separate water outlet 404 is provided at the base of the structure 300. In various embodiments, lateral passages (not shown) are provided at least between adjoining cells in the bottom rear row, so that a single outlet can drain all of the cells 302 in the barrier 300.

Figure 5:
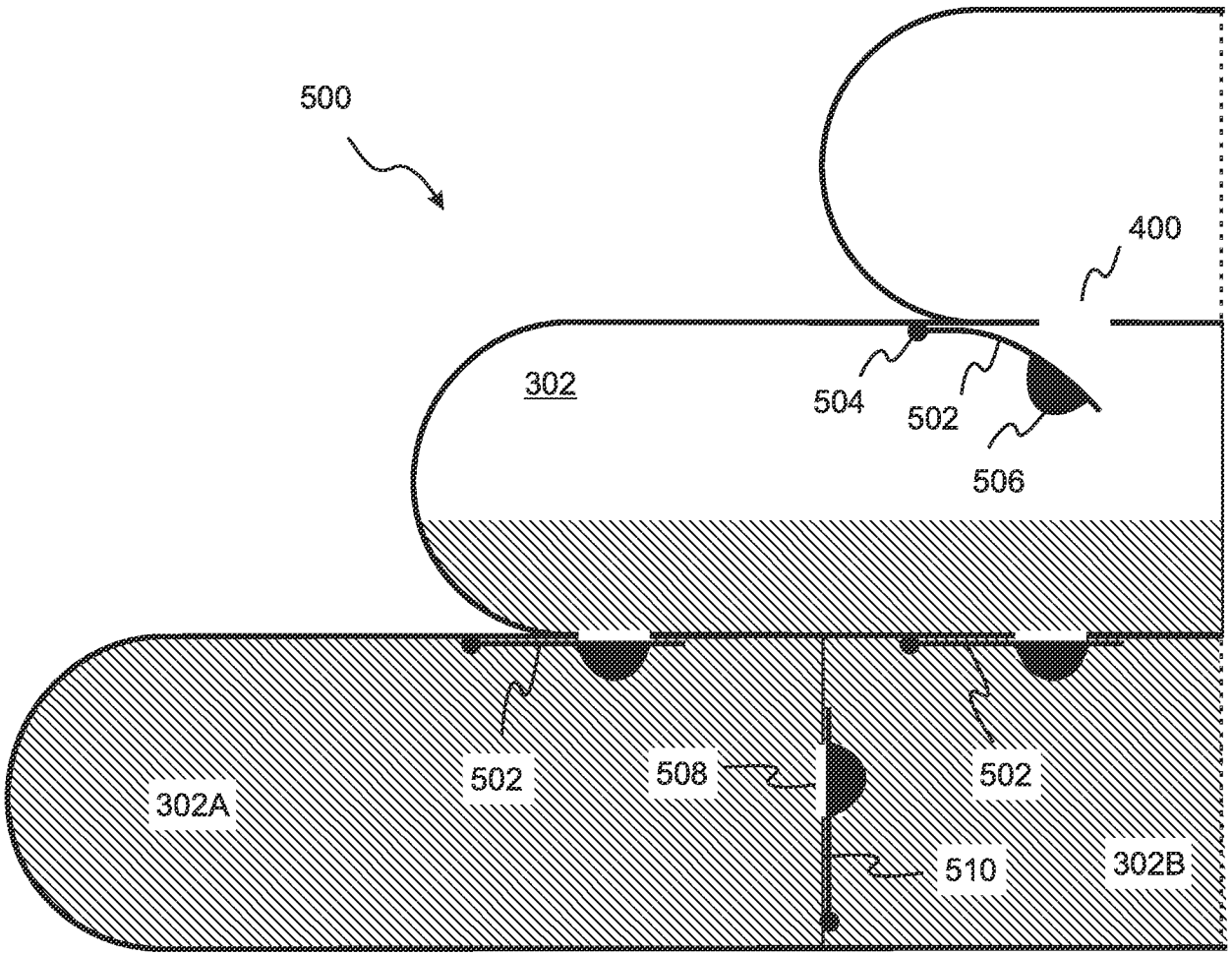
FIG. 5 is a partial cross sectional view of an embodiment having passages between tops and bottoms of cells that are closable by passive valves.

With reference to FIG. 5, in some embodiments 500 the cells 302 include passive automatic valves 500 that seal the passages 400 after the cells 302 are filled with water, so that deflation of one cell due to a puncture or some other cause will not cause the cells beneath it to deflate. In the embodiment 500 of FIG. 5, the valves 502 are flaps of elastic material joined to the upper surfaces of the cells 302 by living hinges 504. A small air bladder 506 is included in the region of the valve 502 that is positioned to cover the passage 400. When the cell 302 is empty, gravity causes the valve 502 to fall away from the passage 400, so that the cell 302 can fill with water. However, once the cell 302 is full of water, the air bladder 506 lifts the valve 502 into place and closes the passage 400. Once the valves 502 are closed, if a cell should develop a leak and deflate, only the cells directly above it will be affected.

In addition, the embodiment 500 of FIG. 5 includes lateral passages 508 between neighboring cells at the lowest level of the barrier, so that the entire barrier can be emptied through a single water outlet 404 located at the lower rear of the structure 500. These lateral passages 508 include automatic valves 510 that will allow water to flow toward the rear as the cells empty from back to front, but will prevent water flowing from rear to front if one of the front cells is damaged.

Typically, the cells in the front row 302, 302A will be the cells that are directly exposed to threats such as debris carried by flood waters. The front cells 302, 302A are therefore the ones most likely to be damaged or punctured. In the embodiment of FIG. 5, if a cell 302A in the bottom front row is punctured, the lateral valve 510 will prevent water from flowing out of the cell next to it 302B and into the damaged cell 302A. However, if the rear cells 302B are drained first during the normal drainage process, then the lateral valves 510 will open and water from the front cells 302A will flow out.

Figure 6:
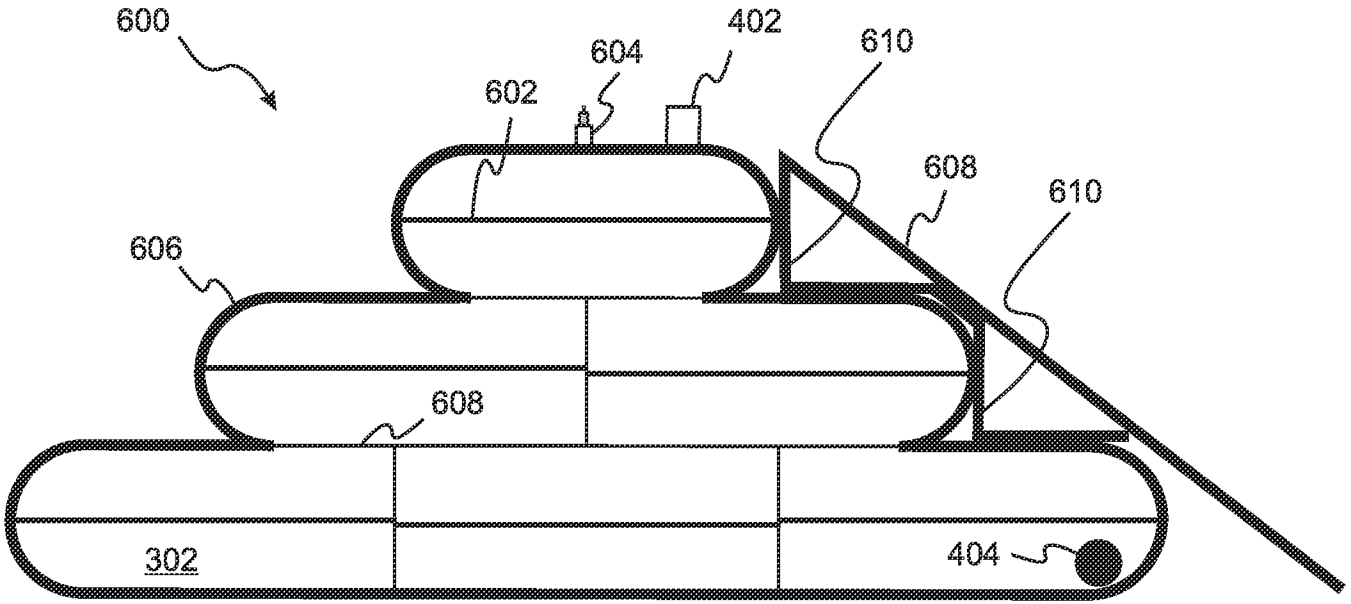
FIG. 6 is a cross sectional view of an embodiment that includes stiffening rods within the cells.

With reference to FIG. 6, in some embodiments the outer shell is made of a much thicker material than the internal cell walls 608, so as to better resist puncture by exterior threats. In similar embodiments, the outer shell 606 is a double layer of material, so that penetration of the outer layer does not affect the adjacent cell, so long as the inner layer remains intact. In various embodiments, only the portion of the outer shell 606 that will face the flood or other threat is thicker, double-walled, or otherwise reinforced.

In embodiments, the internal cell walls enable the barrier 300 to maintain its shape when it is subjected to externally applied lateral forces, such as pressure from flood waters. As illustrated in FIG. 6, in some embodiments, the shape of the barrier 600 is made even more rigid by including within the cells 302 stiff, lightweight rods 602 or panels made of plastic, bamboo, or a similar material.

In certain embodiments, the shape of the barrier is supported by external reinforcing structures. The embodiment of FIG. 608 includes a plurality of bent metal rods 608 that can be located at intervals along the rear side of the barrier 600. The rods 608 include vertical sections 610 that can be placed against the back sides of cells at the rear of the barrier 600 so as to provide further resistance to horizontal forces applied to the front of the barrier.

In various embodiments, the barrier 600 can be initially inflated with air, so that the barrier 600 can be easily positioned while it is in its inflated configuration. The barrier 600 can then be filled with water, while the displaced air is released through a pressure valve 604 at the top of the barrier 600.

Figure 7:
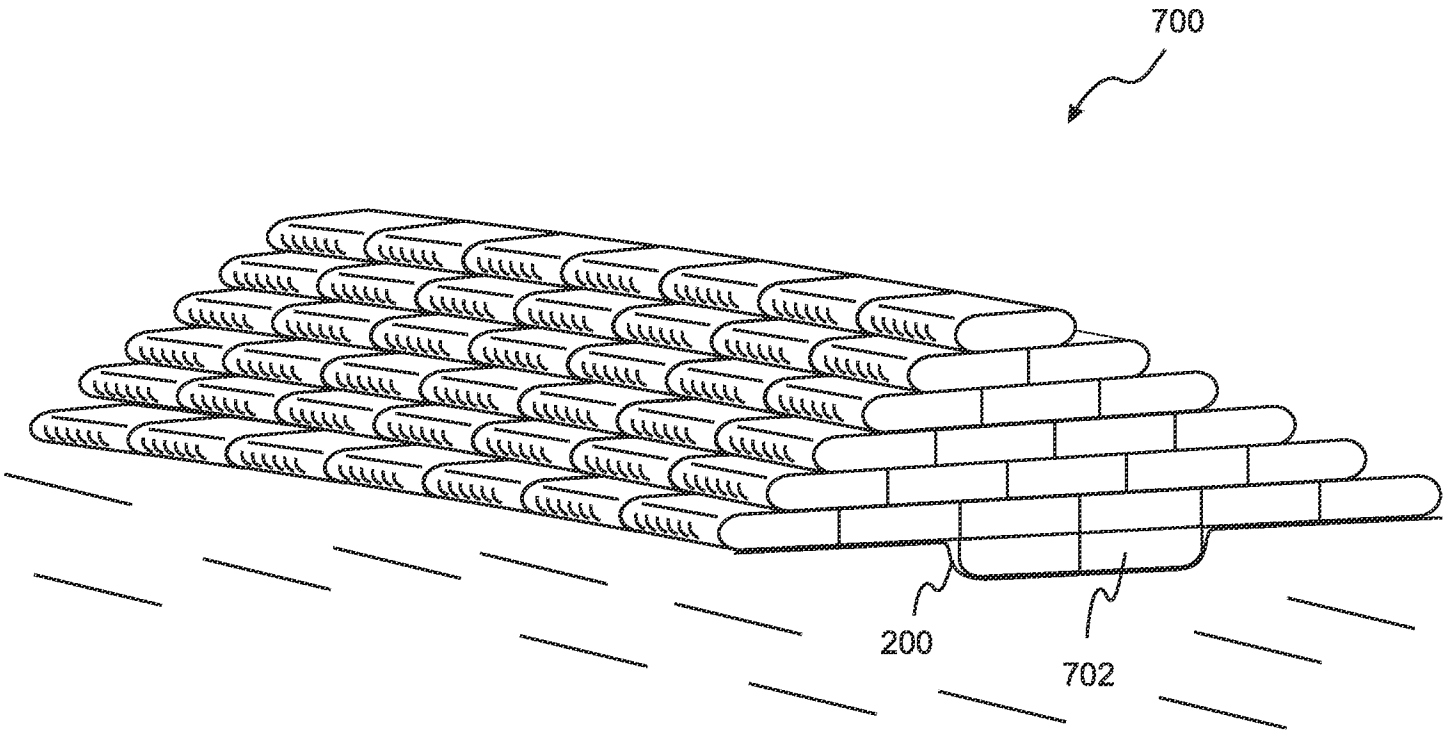
FIG. 7 is a perspective view of an embodiment that has two additional rows of cells at its base that are placed in a trench prepared at the construction site.

With reference to FIG. 7, in further embodiments, additional rows 702 of cells extend below the base of the inflatable barrier 700 so that they can be placed in a trench 200 prepared at the construction site, thereby further resisting dislodgement of the barrier 700 by flood waters or other forces.

Figure 8:
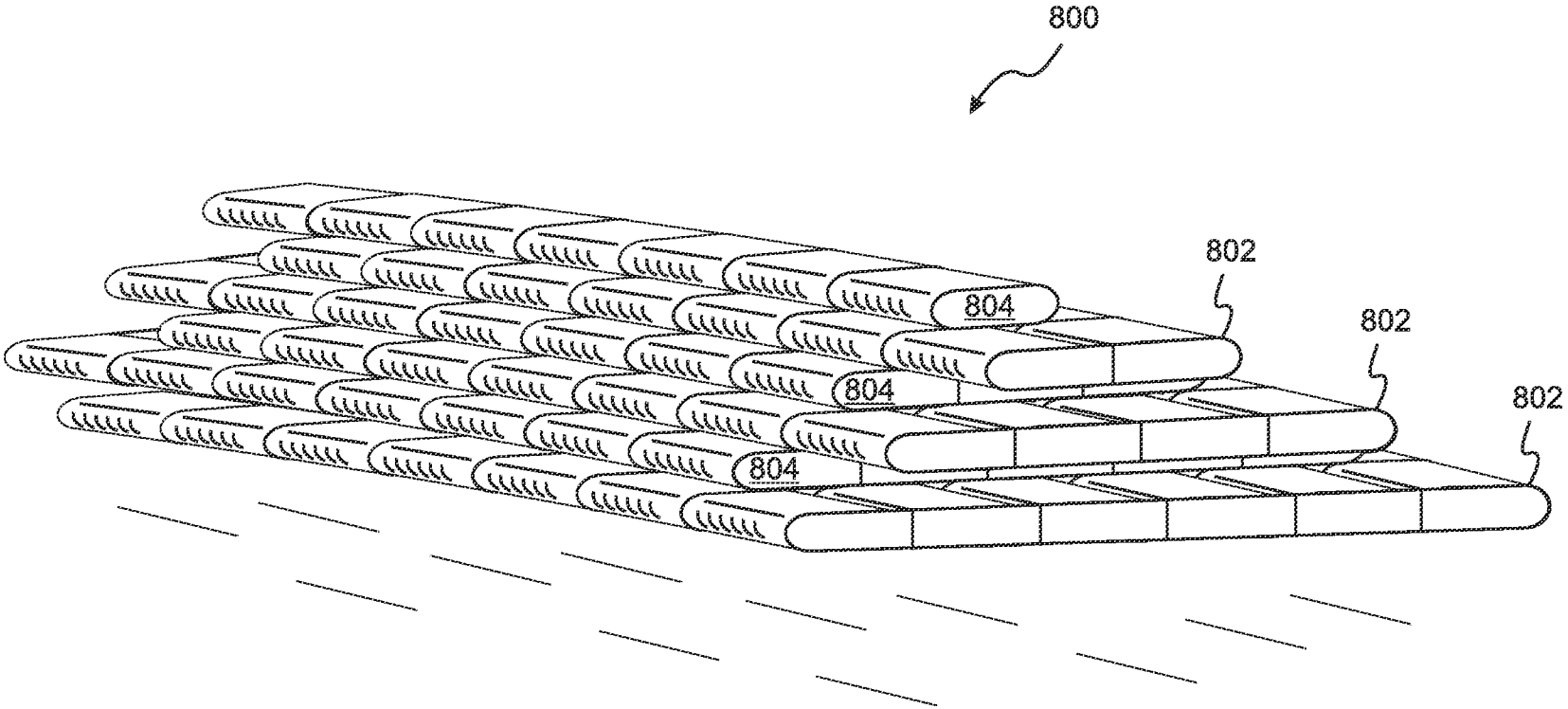
FIG. 8 is a perspective view of an embodiment that has interlocking ends.

In circumstances where a long wall or dike is required, a plurality of barriers of the present invention can be placed side-by-side. With reference to FIG. 8, in some embodiments the barriers 800 have interlocking ends that provide structural cooperation and a water-tight seal between adjacent barriers. In the embodiment of FIG. 8, alternate rows of cells 802 extend from the end by a length of one cell, while the interleaved rows 804 do not. The opposite pattern is provided on the other end of the barrier 800. It can be seen that a second barrier of the same configuration can be positioned so that its extended cells fit between the extended cells 802 of the adjacent barrier 800. In some of these embodiments, as mentioned above, the barrier 800 can be initially filled with air, and then positioned with the ends interlocking, after which the barriers are filled with water while the displaced air is allowed to escape through pressure valves provided at the tops of the barriers 800.

Figure 9A:
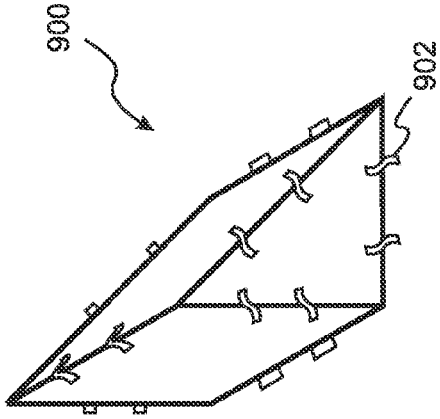
FIG. 9A is a perspective view of an individual, inflatable module having a triangular cross section that can be combined with similar modules to form a barrier in embodiments of the present invention.
Figure 9B:
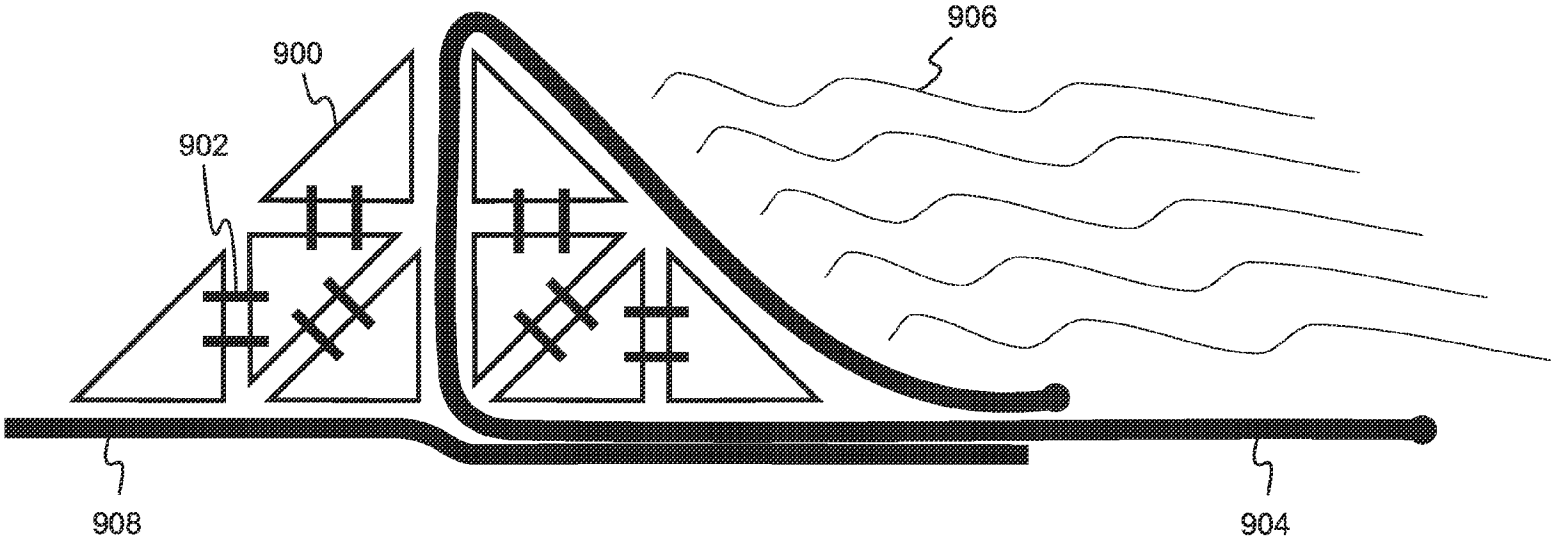
FIG. 9B is a cross-sectional view of a barrier constructed using the modules of FIG. 9A, and further including an anchoring sheet and an underlying sheet.

With reference to FIGS. 9A and 9B, in a second general aspect of the present invention the barrier is assembled from individual, water-inflatable modules 900 that include attachment mechanisms 902 such as ties, hook-and-loop, or some other attachment mechanism known in the art. In the embodiment of FIGS. 9A and 9B, the modules have a triangular cross-sectional shape. As illustrated in FIG. 9B, this enables them to be assembled to form a barrier having a desired overall shape, such as a pyramid. While the base of the barrier is only slightly wider than the height in FIG. 9B, in other embodiments the base is at least six times as wide as the height.

In the embodiment of FIG. 9B, the sloping shape of the water-facing surface causes the water pressure to press the barrier against the ground and thereby increases friction and helps the barrier to resist being shifted horizontally by the water. The embodiment of FIG. 9B further includes an anchoring sheet 904 that is attached to the barrier and extends in front of the barrier, where it is pressed against the ground by the water 906 in front of the barrier, so that there is a high friction between the anchoring sheet 904 and the ground that further inhibits lateral movement of the barrier by the water 906.

The anchoring sheet in the embodiment of FIG. 9B is wrapped around the forward-located modules of the barrier, thereby attaching the anchoring sheet 904 to the barrier. In similar embodiments, the anchoring sheet 904 is wrapped around the entire barrier, or is attached to the barrier by some other means known in the art.

In some embodiments, the anchoring sheet 904 is sufficiently flexible to allow it to conform closely with the underlying shape of the water-facing surface. And in some of these embodiments, the anchoring sheet 904 is made from a material that naturally clings to the water-facing surface of the barrier due to static electrical attraction.

In embodiments, the flexible material of the barrier allows the base of the barrier to form a seal with ground even if the ground is rough. The embodiment of FIG. 9B further includes a flexible underlying sheet 908 that increases resistance to puncture of the barrier from beneath, and which forms a seal with the ground so as to further resist penetration of water beneath the barrier. In some of these embodiments, the underlying sheet 908 includes a cushioning layer such as foam or a puncture-proof air bag that enables the underlying sheet to form a seal with very rough ground, and also further helps to avoid puncture of the barrier from beneath. In certain of these embodiments, the underlying sheet 908 is filled with dry sand, foam or some other compliant material that will not get wet from the flood water.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A water inflatable barrier comprising:

a flexible shell configured to contain water in its interior, the shell having a front, a rear, and a substantially uniform cross-section along its width, the cross section being wider at a base of the shell than at a top of the shell;

a plurality of water-tight partitions bounded by horizontal and vertical partition walls, each of said vertical partition walls being oriented either substantially parallel to the front of the flexible shell or substantially perpendicular to the front of the flexible shell, said water-tight partitions dividing the interior of the shell into a plurality of adjacent cells having substantially identical dimensions, the cells being shaped approximately as rectangular parallelepipeds arranged in a plurality of horizontal layers that are vertically stacked on top of each other and offset from each other such that none of the vertical partition walls that are parallel to the front of the flexible shell aligns with a vertical partition wall in a vertically adjacent layer, each of widths and lengths of the cells being at least twice as large as heights of the cells;

a plurality of vertical openings configured to allow water to flow vertically between the cells;

a plurality of horizontal openings configured to allow water to flow horizontally between at least some of the cells;

a water inlet proximal to the top of the shell and configured to allow filling of the shell with water; and a water outlet proximal to the base of the shell and configured to allow draining of water from the shell.

2. The barrier of claim 1, further comprising an automatic valve cooperative with a vertical opening and configured to automatically seal the vertical opening when the cell below the vertical opening is filled with water.

3. The barrier of claim 1, further comprising an automatic valve cooperative with a horizontal opening and configured to automatically seal the horizontal opening when the cell located to the rear of the horizontal opening is filled with water.

4. The barrier of claim 1, further comprising a structure reinforcing element contained within a cell and configured to maintain at least one of a length and a width of the cell in which it is contained.

5. The barrier of claim 4, wherein the structure reinforcing element is a rod or a plate.

6. The barrier of claim 4, wherein the structure reinforcing element is made of plastic, wood, or bamboo.

7. The barrier of claim 1, further comprising a structure reinforcing element that is external to the shell.

8. The barrier of claim 1, wherein the barrier includes an interlocking end structure configured to interlock with a second barrier having a compatible end structure.

9. The barrier of claim 1, wherein the barrier is inflatable with air.

10. The barrier of claim 9, further comprising an air pressure relief valve configured to permit air to escape from the shell as the barrier is filled with water.

11. The barrier of claim 1, wherein the base of the barrier is flat.

12. The barrier of claim 1, wherein the base of the barrier includes at least one row of cells extending below other rows in the base, the extended rows being configured for placement in a trench prepared at a site where the barrier is to be installed.

13. The barrier of claim 1, wherein at least the front of the flexible shell is reinforced as compared to the internal partitions.

14. The barrier of claim 13, wherein the front of the flexible shell is reinforced due to an increased thickness of material relative to the internal partitions.

15. The barrier of claim 13, wherein the front of the flexible shell is reinforced due to inclusion of a material not included in the internal partitions.

16. The barrier of claim 13, wherein the front of the flexible shell is reinforced due to inclusion of nanofiber in the flexible shell.

17. The barrier of claim 13, wherein the front of the flexible shell is reinforced due to double-walled construction.

18. The barrier of claim 1, wherein the outer shell includes a coating of a protective material that tends to seal punctures in the outer shell.

19. The barrier of claim 18, wherein the protective material is tyvec or liquid rubber.

20. The barrier of claim 1, further comprising an underlying sheet that further resists punctures of the barrier from beneath, and which seals to the barrier and to the ground beneath the barrier so as to inhibit penetration of water beneath the barrier.

21. The barrier of claim 20, wherein the underlying sheet is a cushioning layer.

22. The barrier of claim 20, wherein the underlying sheet is filled with dry sand or foam.

23. A water inflatable barrier comprising:

a plurality of flexible shells configured to contain water in their interiors, the shells having substantially uniform cross-sections along their lengths;

fastening mechanisms included on each of the flexible shells, at least some of the flexible shells being interconnected by the fastening mechanisms into a barrier structure having a plurality of adjacent flexible shells arranged in a plurality of layers of horizontal rows that are vertically stacked on top of each other; and a water-tight cover that provides a water-impenetrable barrier on a forward-facing surface of the barrier structure, the barrier extending below at least one row of a lowest layer of the flexible shells, vertically up through a space between the stacked rows, and over the forward-facing surface of the barrier.

24. The barrier of claim 23, wherein the water-tight cover is attached to the interconnected flexible shells.

25. The barrier of claim 24, wherein the water-tight cover surrounds the interconnected flexible shells.

26. The barrier of claim 24, wherein a forward portion of the water-tight cover extends forward beyond the forward-facing surface, so that water standing in front of the barrier applies a gravitational downward force to the forward portion that inhibits water from penetrating under the forward portion and inhibits the water from shifting or tipping the barrier.

27. The barrier of claim 23, wherein the flexible shells are made from a material that includes nanofiber.

28. The barrier of claim 23, wherein the water-tight cover is made of a material that is sufficiently flexible to conform closely with the forward-facing surface.

29. The barrier of claim 28, wherein the water-tight cover is made from a material that naturally clings to the forward-facing surface due to static electrical attraction.

30. The barrier of claim 23, further comprising an underlying sheet that further resists punctures of the barrier from beneath, and which seals to the barrier and to the ground beneath the barrier so as to inhibit penetration of water beneath the barrier.

31. The barrier of claim 30, wherein the underlying sheet is a cushioning layer.

32. The barrier of claim 30, wherein the underlying sheet is filled with dry sand or foam.

33. The barrier of claim 23, wherein a width at the base of the barrier is at least six times as great as a height of the barrier.

* * * * *